US005246742A

United States Patent [19]

Rödhammer

[11] Patent Number: 5,246,742

[45] Date of Patent: Sep. 21, 1993

[54] METHOD OF POSTTREATING THE FOCAL TRACK OF X-RAY ROTARY ANODES

[75] Inventor: Peter Rödhammer, Reutte, Austria

[73] Assignee: Schwarzkopf Technologies Corporation, New York, N.Y.

[21] Appl. No.: 879,175

[22] Filed: May 5, 1992

[30] Foreign Application Priority Data

May 7, 1991 [AT] Austria ..... 974/91

[51] Int. Cl.[5] ..... B05D 1/36

[52] U.S. Cl. ..... 427/552; 427/256; 427/367; 427/383.1; 427/555

[58] Field of Search ..... 427/552, 555, 367, 383.1, 427/256; 428/457, 689

[56] References Cited

FOREIGN PATENT DOCUMENTS 0116385 1/1984 European Pat. Off. .

109768 11/1974 Fed. Rep. of Germany .

*Primary Examiner*—Bernard Pianalto

*Attorney, Agent, or Firm*—Morgan & Finnegan

[57] ABSTRACT

The invention relates to a method of producing an X-ray rotary anode having a focal track region composed of refractory metals. The focal track region is manufactured by means of powder-metallurgy methods or by means of CVD or PVD methods. According to the invention, the focal track region is posttreated using high-energy electrons or photons by means of local, superficial melting to a depth of less than 1.5 mm. This reduces, in particular, the residual porosity in the focal track region. That results in improved mechanical properties, higher X-ray yield and markedly improved service life of such rotary anodes.

8 Claims, No Drawings

METHOD OF POSTTREATING THE FOCAL TRACK OF X-RAY ROTARY ANODES

The invention relates to a method of producing an X-ray rotary anode having an annular focal track region manufactured by powder metallurgy or by means of CVD or PVD methods and composed of refractory metals, for example tungsten or tungsten/rhenium.

Refractory metals or graphite, or a composite of the two materials, are nowadays used as the basic raw material for X-ray rotary anodes. The actual region of generation of the X-radiation, the focal track region, is composed of tungsten, molybdenum or their alloys.

Metallic X-ray rotary anodes are produced by sintermetallurgy methods for reasons of shape, the raw materials used and the required properties; the focal track region itself is generated by sinter-metallurgy methods or recently to an increasing extent also by means of CVD or PVD coating methods. In the finished state, such rotary anodes or focal track regions have a residual porosity in the 0.1–10% range, measured on the basis of the theoretical density. Such an X-ray rotary anode is described in EP-Al-0 116 385, the rotary anode being optionally posttreated or heat-treated according to the method therein after deposition of the focal track layer.

This residual porosity has a number of disturbing disadvantages for the operation of X-ray rotary anodes, which is always carried out in a high vacuum. The porosity causes the release of gases enclosed in the pores. That results in turn in gas discharges in the high vacuum of the tubes, with undesirable tube short circuits which, in turn, cause incipient anode melting. The thermal conductivity, which is so important for the loadcarrying capacity of X-ray tubes, decreases approximately with the square of the porosity. Porosity in the focal track surface causes increased surface roughness and reduces the X-ray yield owing to self-absorption. A porous surface also implies, however, the risk of particle detachment from the surface, and this also substantially intensifies the adverse effects of gas escapes.

The mechanical bonding of the individual crystallites in the structure is dependent on the porosity and also on the metallurgical states at the grain boundaries, in particular on impurities at the grain boundaries. However, a concentration of impurities which are insoluble in the metal at the grain boundaries is unavoidable in the course of powder-metallurgy production methods; this implies a further disturbing factor in the operation of X-ray rotary anodes.

Focal track coatings produced by sintermetallurgy methods and composed, in particular, of tungsten/-rhenium occasionally exhibit locally a brittle, intermetallic tungsten/rhenium phase, the so-called sigma-phase, which is attributable to inhomogeneities due to inadequate blending of the individual alloy components in the powder mixture. The unavoidable thermal shock loading of rotary anodes during operation then results in an extremely undesirable crack formation, with a reduction in the X-ray yield in the focal track region as a consequence, in particular in these regions and in regions proceeding from them.

The disturbances described above, which occur with varying frequency, limit the service life and result in individual cases in premature failure of the X-ray rotary anodes.

The object of the present invention is accordingly to eliminate or at least substantially reduce the abovementioned disadvantages. The object is, in particular, to reduce the porosity and the impurities, in particular at the grain boundaries in the focal region. The previous production methods (powder metallurgy and CVD or PVD methods) should be retained because of their cost effectiveness and the good raw material properties resulting therefrom.

The object is achieved, according to the invention, by a method according to which the focal track region of an X-ray rotary anode is posttreated by means of local, superficial melting to a depth of less than 1.5 mm.

In accordance with a method tried and proven in practice, the posttreatment according to the invention by means of superficial melting is carried out by the action of focused beams of high-energy electrons or photons on the surface of the focal track region of X-ray rotary anodes down to a certain depth of action. The melting produces in these regions an altered metallic structure, and the porosity and the proportion of impurities, in particular in the grain boundary region, are quite substantially reduced. In contrast to standard melt metallurgical methods, the grain structure remains comparatively fine owing to the very local melting and the very rapid cooling after the melting. The achievable grain size is equivalent to that which is standard in focal track regions produced by powder metallurgy or by means of application methods.

The melting may take place once or even several times one after the other and modifies the metallic structure of the focal track region achievable in the final state. With the elimination of the residual porosity, the previous disturbances in the operation of X-ray rotary anodes referred to in the introduction also disappear.

Lasers, apparatus for generating particle beams, in particular electron beams, and highly focusable high-power lamps are suitable focusable energy sources for the melting process. The material-specific degree of transformation of irradiated energy/heat is of importance for the energy source chosen in the individual case. The complexity of the apparatus and the procedure, for example treatment under protective gas or in high vacuum, furthermore play a part. Owing to the high reflectivity of refractory metals for electromagnetic waves in the 0.3–20 μm spectral range (>80%), the use of electron beams having an efficiency of ≧60% as a rule offers advantages.

The desired melting depth according to the inventive method should be dimensioned so as to match the thermomechanical stressing of the focal track region to be expected in operation. A melting depth of between 0.05 and 1.5 mm has proved to be serviceable. In the predominant number of application cases, a melting depth of between 0.5 and 0.8 mm offers the best cost/benefit ratio.

The process of melting and rapidly cooling yields, depending on processing, the structural states of amorphous, very fine grained and isotropic, fine stalklike or coarsely crystalline. The stresses occurring in the structure can be eliminated by a subsequent vacuum anneal in the 900°–1,600° C. range.

In the focal track region, the melting process results in a very smooth surface of low surface roughness. Nevertheless because of the extremely high requirements imposed on the surface smoothness of X-ray rotary anodes in the focal track region, regrinding the surfaces after the melting process is as a rule unavoidable.

The method according to the invention is described in greater detail by reference to an example. A rotary anode parent body produced by standard powder metallurgy and having a tungsten/rhenium focal track region is mounted—as it is also later in operation—on a rotating holding shaft and placed in a bulb which can be evacuated to high vacuum. The rotary anode focal track region is at the same time placed opposite a focusing incandescent emission cathode. The slowly rotating rotary anode is first brought to approximately 800° C. by means of a defocused electron beam. During this process, the rotary anode is degassed, that is to say, foreign atoms and inadequately adhering material particles are removed from the surface. Then the electron beam is set to a line focus of 20 mm length and 2 mm width and to a power of 6 kW, and the rotary anode, rotating at 3–6 revolutions per minute, is superficially melted in three consecutive revolutions. This produces a molten zone of approximately 17 mm width and 0.7 mm mean depth. The melt, which is always horizontal because of the arrangement, solidifies during the subsequent cooling with such smoothness that a smooth focal track coating surface meeting the requirements is achieved even with a subsequent abrasion of 0.2–0.3 mm.

The structure of a focal track region melted in this way has directionally solidified crystallites having a mean diameter of 150 μm. It exhibits no pores and gives reliable indications of an excellent bonding of the individual grains or crystallites to one another.

An X-ray rotary anode produced in accordance with the present invention was compared with a rotary anode manufactured in accordance with the prior art. In a so-called tube test bed, in which the loading of the X-ray rotary anode can be simulated so as to be completely identical to that in future operation, both comparison rotary anodes were tested with the following loading cycles: electron beam power 60 kw, focus $12\times1.8$ mm$^2$, irradiation cycle $7\times0.1$ s with an interval of 0.1 s in each case (equivalent to a radiogram) and 59 s cooling, total number of radiograms 1,200.

After termination of this test, the two comparison rotary anodes were tested in relation to their superficial structural changes both in a scanning electron microscope and by means of a stylus for surface roughness.

The mean peak-to-valley height $R_a$ in the rotary anode in accordance with the prior art was $R_a=5.5$ μm, while the rotary anode in accordance with the present invention had a mean peak-to-valley height of $R_a=3.5$ μm. The roughening of the rotary anode in accordance with the present invention as a consequence of material fatigue was not only lower, but, based on the entire focal track region, more uniform than in the case of the rotary anode in accordance with the prior art. Correspondingly, the X-ray rotary anode according to the invention exhibited a more uniform and less dense network of cracks, with smaller crack widths, than the comparison anode in accordance with the prior art. The rotary anode according to the invention has a very high vacuum stability. As a result, the so-called running-in phase, in which a rotary anode is heated in the tube under the electron beam with continuous pumping-off of escaping residual gases and is first brought to operating conditions, can be markedly shortened. The electrical stability of the rotary anode was perfect in operation.

The X-ray dose per radiogram measured at the end of the test was 20% higher in the rotary anode produced in accordance with the invention than in the comparison anode in accordance with the prior art.

The life expectancy of the X-ray rotary anode was consequently markedly higher than that of the comparison anode because of the abovementioned improvements in quality.

I claim:

1. A method of producing an X-ray rotary anode having an annular focal track region manufactured by powder metallurgy or by means of CVD or PVD methods and composed of refractory metals, which method comprises posttreating the focal track region by means of local, superficial melting to a depth of less than 1.5 mm.

2. The method of producing an X-ray rotary anode as claimed in claim 1, wherein the melting takes place down to a depth of between 0.05 and 1.5 mm.

3. The method of producing an X-ray rotary anode as claimed in claim 1, wherein the melting takes place down to a depth of between 0.5 and 0.8 mm.

4. The method of producing an X-ray rotary anode as claimed in anyone of claims 1 to 3, wherein the melting is carried out by means of a focused electron beam.

5. The method of producing an X-ray rotary anode as claimed in anyone of claims 1 to 3, wherein the melting is carried out by means of a laser beam.

6. The method of producing an X-ray rotary anode as claimed in any one of claims 1 to 3, wherein the surface of the molten region is mechanically smoothed.

7. The method of producing an X-ray rotary anode as claimed in any one of claims 1 to 3, wherein the molten region is additionally subjected to an annealing treatment.

8. The method of producing an X-ray rotary anode as claimed in anyone of claims 1 to 3, wherein the melting of the focal track region is repeated once or several times.

* * * * *